United States Patent [19]

Breidenbach et al.

[11] 4,422,902

[45] Dec. 27, 1983

[54] METHOD OF OPERATING A COKE OVEN

[75] Inventors: Dieter Breidenbach, Waltrop; Wilhelm Mosebach, Kamen-Metheler, both of Fed. Rep. of Germany

[73] Assignee: WSW Stahl-Und Wasserbau GmbH, Riphaushof, Fed. Rep. of Germany

[21] Appl. No.: 303,609

[22] Filed: Sep. 18, 1980

Related U.S. Application Data

[62] Division of Ser. No. 182,004, Aug. 27, 1980, abandoned.

[30] Foreign Application Priority Data

Nov. 8, 1979 [DE] Fed. Rep. of Germany ..... 2945017
Jan. 4, 1980 [DE] Fed. Rep. of Germany ..... 3000161

[51] Int. Cl.[3] ..... C10B 23/00; C10B 27/00
[52] U.S. Cl. ..... 201/14; 201/41
[58] Field of Search ..... 202/248, 268; 201/14, 201/41; 110/173 R; 49/483, 485

[56] References Cited

U.S. PATENT DOCUMENTS 2,308,999 1/1943 Moore ..... 202/248
2,855,347 10/1958 Cellan-Jone ..... 202/248
2,993,845 7/1961 Coe ..... 202/248
4,086,145 4/1978 Muller ..... 202/248
4,118,284 10/1978 Bowman et al. ..... 202/248
4,197,163 4/1980 Aikman ..... 202/248
4,217,177 8/1980 Gerding et al. ..... 202/248

FOREIGN PATENT DOCUMENTS 1087455 2/1955 France ..... 202/248
1102059 10/1955 France ..... 202/248

*Primary Examiner*—Bradley Garris
*Attorney, Agent, or Firm*—Joseph J. O'Keefe; Karl F. Ross

[57] ABSTRACT

A coke-oven door for use in combination with a coke-oven chamber having an upright doorjamb has a door panel whose periphery is complementary to the doorjamb and which is provided with a seal extending around that periphery between the same and the doorjamb. A plug with a heat-insulating outer wall is carried on this panel within the seal and projects through the doorjamb into the chamber. This plug is formed with a vertically extending and upwardly open passage bounded by a metallic inner wall having gaps by which gases produced during coking adjacent the plug enter the passage on their way to a flue, exchanging heat through the metallic wall with the charge in the oven and thereby aiding the coking operation.

2 Claims, 8 Drawing Figures

METHOD OF OPERATING A COKE OVEN

This is a division of application Ser. No. 182,004, filed Aug. 27, 1980, now abandoned.

FIELD OF THE INVENTION

The present invention relates to a method of operating a coke oven.

BACKGROUND OF THE INVENTION

A coke oven normally has a battery of coking chambers of rectangular horizontal outline that are separated from one another by heated walls defining their longer sides and are open at their two narrower horizontal ends. These ends are provided with the doorjambs against which respective coke-oven doors can snugly fit during the coking operation to hold the charge in the respective chamber and to prevent the escape of gases and heat from the chamber. These doors, as described on pages 120 ff of *The Making, Shaping and Treating of Steel* by H. McGannon (Herbick & Hood:1971), each have a rigid panel with a periphery complementary to the respective doorjamb. A seal is provided at this periphery for forming a gastight connection between the periphery and the doorjamb, and holding structure is provided to press the door tightly over the respective doorjamb. Extending inwardly from the inner face of this panel is a vertically elongated and horizontally projecting plug of refractory insulating material that extends into the respective coking chamber. The insulating plug prevents the door from being heated excessively while similarly preventing the ends of the charge inside the chamber from being inadequately coked because of excessive cooling. Gases generated during the coking operation normally are drawn off from the space formed between the upper level of the charge and the roof of the chamber.

The plugs normally project some 400 mm from the doors into the chambers and serve to protect the iron door parts. These plugs are conventionally formed of a plurality of interfitting refractory bricks which are very heavy and relatively expensive to mount in place and maintain. Normally the chambers also have a refractory linig that projects outward roughly to the level of the refractory lining of the door, leaving a gap. As this gap fills with particulate material during use it must be meticulously cleaned after each coking operation. The inevitable thermal leakage at this gap normally also prevents complete coking of the ends of the charge, while permitting some gas leakage around the door.

OBJECTS OF THE INVENTION

The object of our present invention is to provide an improved method of operating a coke oven.

SUMMARY OF THE INVENTION

In accordance with our instant invention, a coke-oven door is formed with a vertical passage open at both ends, the upper end opening above the charge or coke in the oven. The passage is accessible to the coking chamber whereby gases generated during the coking operation at the critical end regions of the coke charge can rise through this passage toward a flue while at the same time transferring their heat through a thermally conductive partition back to the charge by way of an inner vertical wall of the passage in the form of a heat-transmitting plate, e.g. of cast iron. This plate, therefore, ensures excellent heat conduction vertically along the end of the charge while also preventing the charge from wearing away the less durable insulating material of the outer plug wall. To this end the plate and the plug have an overall horizontal thickness approximately equal to the horizontal thickness of the normal insulating plug of a coke-oven door. A thermally insulating layer on an outer wall of the passage prevents the escape of heat from the gases to the exterior.

The use of heat-resistant plates for the door gives it a nearly unlimited service life and semicoked coal and graphite are unable to adhere well to it so that they can easily be cleaned off the door. Moreover the use of such heat-transmitting material ensures that the ends of the coke charge are fully coked since heat is supplied not only laterally through the lateral walls of the oven chamber, as in conventional coke-oven batteries, but also from the ends formed by the doors. The plug can project some 80 mm–100 mm less far into the chamber so as to increase the overall capacity of the chamber by 1–2%. Furthermore, the door according to the instant invention can be some 80% lighter than the prior-art doors having massive refractory plugs.

SPECIFIC DESCRIPTION

Figure 1:
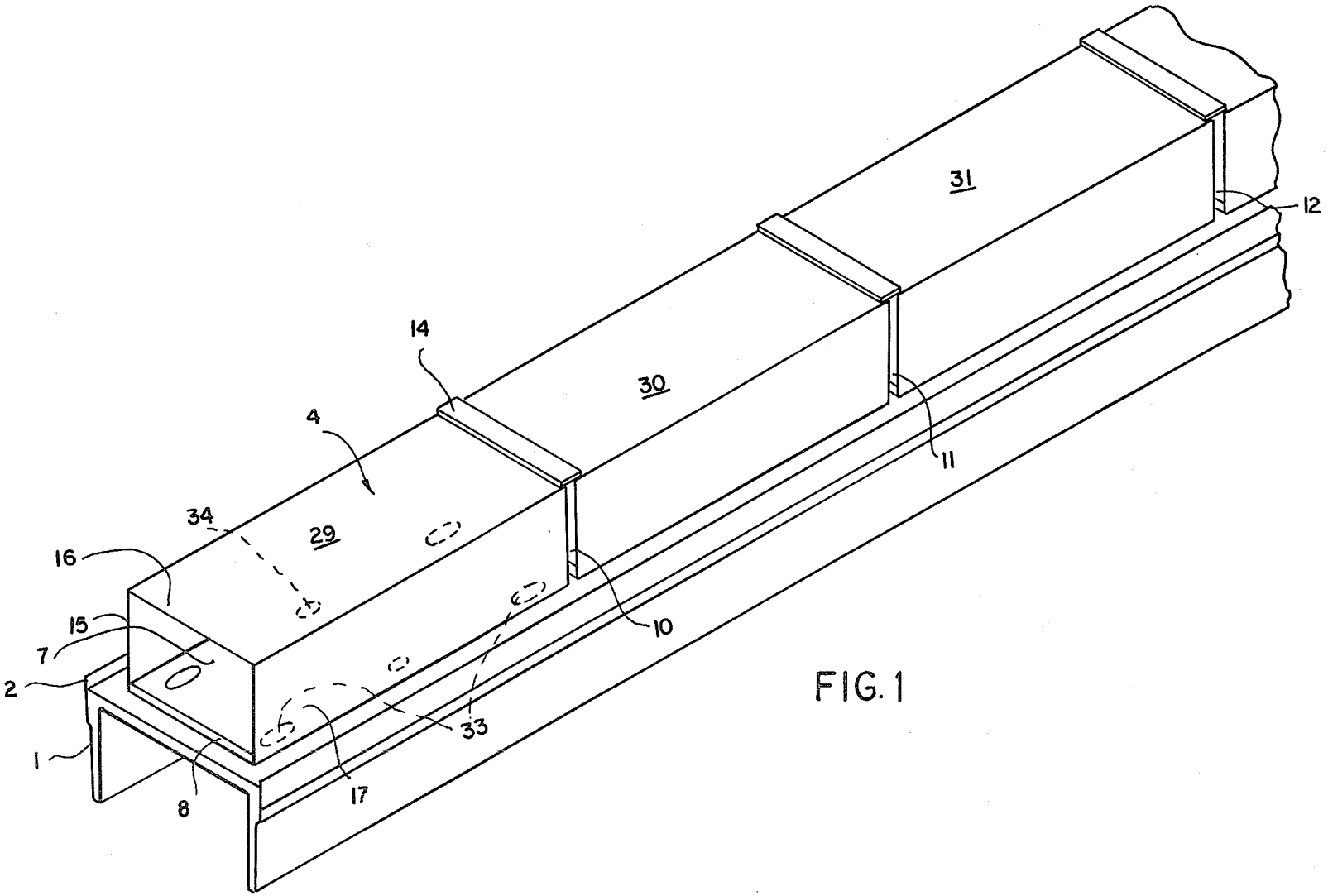
FIG. 1 is a perspective view of a coke-oven door enabling the endwise heating of a coking charge in accordance with our invention.
Figure 2:
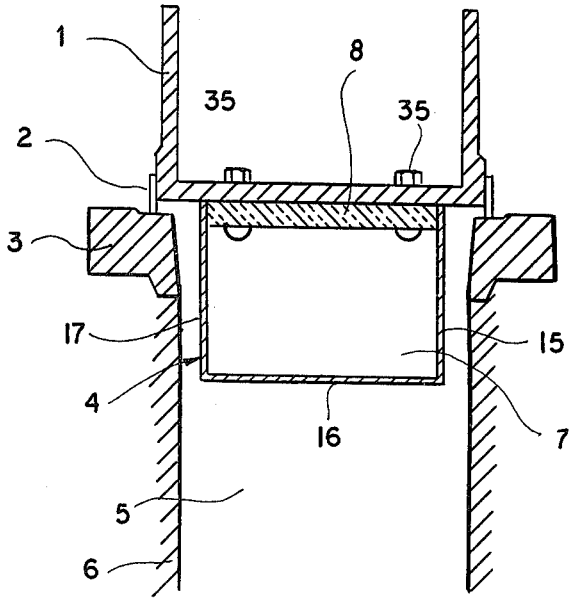
FIG. 2 is a cross section through the door of FIG. 1.
Figure 2A:
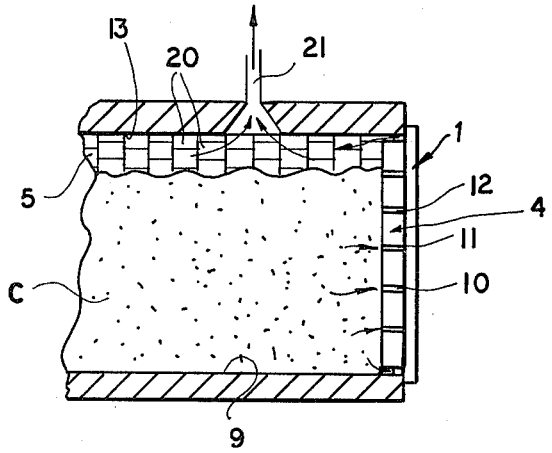
FIG. 2A is a small-scale largely schematic view illustrating a coke oven provided with the door of FIGS. 1 and 2.

As shown in FIGS. 1, 2 and 2A, a coke-oven door according to this invention has a rigid frame or panel structure 1 provided around its periphery with a seal 2 engageable with a doorjamb 3 of a coke-oven chamber 5. A plug 4 projects inwardly from the door 1 beyond the doorjamb 3 and is spaced slightly inward of side walls 6 of the chamber 5. As shown in FIG. 2A, this chamber 5 contains a charge C of coal and has a floor 9 and a ceiling 13. The side walls 6 carry bricks 20 of refractory material (heated by conventional means not shown) and an ascension pipe or flue 21 is provided for drawing off gases generated during the coking operation. The overall chamber height is 7 m and its usable width is 45 cm.

The plug according to this invention is constituted as a plurality of metallic channel sections 29, 30, and 31, each formed by a pair of side walls 15 and 17 bridged by an end plate 16. Between the outer edges of the side walls 15 and 17 a body 8 of fiber-glass insulation is provided and a throughgoing vertical passage or compartment 7 is formed within the plug 4.

The sections 29, 30, 31 etc. are separated by gaps 10, 11 and 12, which alloy gases escaping from the charge C to enter the compartment 7 during the coking operation. To prevent particulate material from entering, small covers 14 overlie the gaps 10–12 at the end plates 16, each cover 14 being secured to only one of the respective end plates 16. Thermal expansion and contraction are allowed for by securing each of the sections 29–31 to frame 1 at its center via round holes 34 and adjacent its ends via elongate holes 33 receiving bolts 35. The sections 29–31 are made of heavy heat-resistant and heat-conducting steel.

Thus, as seen in FIG. 2A, during the coking operation gases generated by the charge C enter the passage 7 not only at the gaps 10–12, but also at the lower open end of the plug 4. These gases can reach the flue 21 through the upper end of the plug 4 which lies above the charge C. In this manner not only can these gases be carried away for effective coking, but their heat will be transmitted back to the charge C through the end plates 16 as they rise in the compartment 7. With identical doors at both ends of coking chamber 5, the charge C is heated at all four sides.

Figure 3:
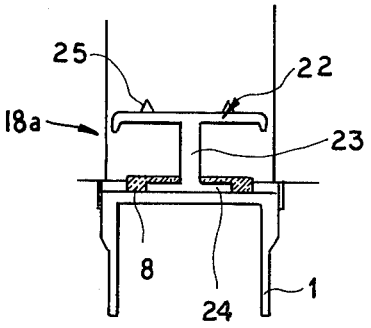
FIGS. 3 and 4 are small-scale cross sections through further doors enabling the practice of our invention.
Figure 5:
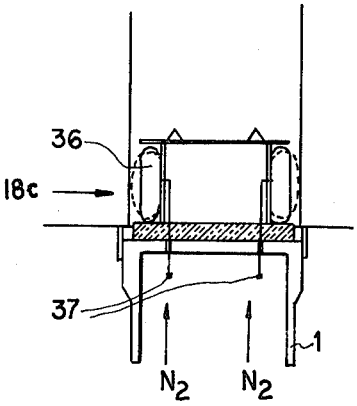
FIG.5 is a perspective view similar to FIG. 1 but showing the door of FIG. 3.
Figure 6:
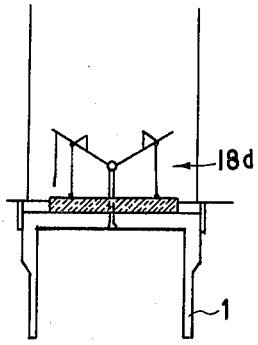
Figure 7:
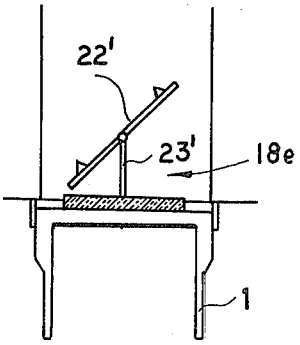
Figure 8:
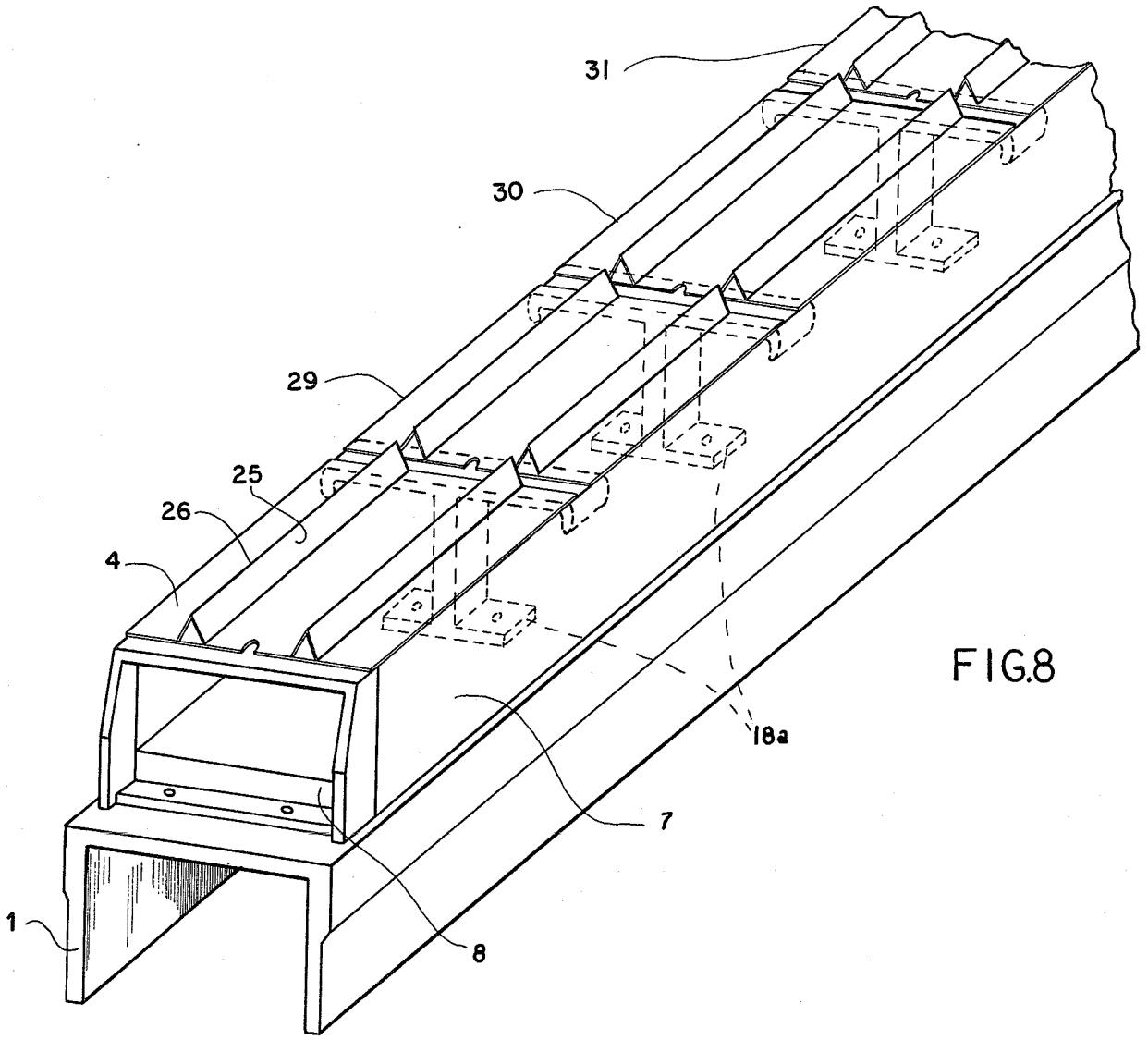

FIGS. 3 and 5 show the use of T-shaped supports 18*a* each having a flange 22, a foot 24, and a web 23 connecting them. The foot 24 is bolted to the C-profile panel and covered by the insulation 8. The plates 16 of wall sections 29–31 (omitted in FIG. 3) overlie the flange 22, and angle irons 25 opening backwardly toward the panel 1 as indicated in FIG. 5 also are provided on top of the plates 16. These angle irons 25 have their apices 26 pointing into chamber 5 and are spaced apart at their ends so that they also serve to conduct gases upward during the coking operation.

Figure 4:
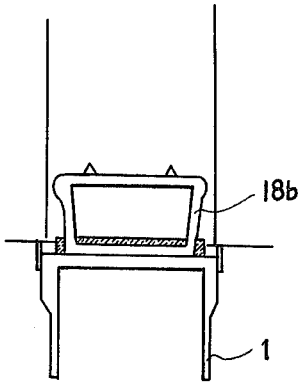

FIG. 4 shows a support 18*b* of closed annular shape.

We claim:

1. In a method of operating a coking chamber of rectangular horizontal outline, with major sides bounded by heated lateral walls and with minor sides closed by respective doors, to transform a charge of coal in said chamber into coke by heat transmitted thereto through said lateral walls, the improvement whereby hot gases evolving from the charge under the transmitted heat are channeled toward a flue through a vertical passage in each door separated from the interior of the chamber only by a thermally conductive metal partition in contact with the charge whereby the gases rising in said passage transfer part of their heat through said partition by excellent heat conduction to the end region of said charge in contact with said partition to ensure full coking of said charge along said end region thereof, the heat of the gases being prevented by a thermally insulating layer on an outer wall of said passage from escaping to the exterior.

2. In a method of operating a coking chamber of rectangular horizontal outline, with major sides bounded by heated lateral walls and with minor sides closed by respective doors, to transform a charge of coal in said chamber into coke by heat transmitted thereto through said lateral walls, the improvement whereby hot gases evolving from the charge under the transmitted heat are channeled toward a flue through a vertical passage in at least one door separated from the interior of the chamber only by a thermally conductive metal partition of said door in contact with the charge whereby full coking of said charge along the end region thereof in contact with said partition is ensured by gases rising in said passage and transferring part of their heat through said partition by excellent heat conduction to the end region of said charge in contact with said partition, the heat of the gases being prevented by a thermally insulating layer on an outer wall of said passage from escaping to the exterior.

* * * * *